United States Patent [19]

Yasumi et al.

[11] Patent Number: 5,007,752

[45] Date of Patent: Apr. 16, 1991

[54] PAPER FEED ROLLER ARRANGEMENT FOR PRINTER

[75] Inventors: Yoshiyuki Yasumi; Hiroshi Sato, Iwate, both of Japan

[73] Assignee: Alps Electric Co., Ltd., Tokyo, Japan

[21] Appl. No.: 388,265

[22] Filed: Aug. 1, 1989

[30] Foreign Application Priority Data

Aug. 5, 1988 [JP] Japan ..... 63-103745[U]

[51] Int. Cl.[5] ..... B41J 13/03

[52] U.S. Cl. ..... 400/636; 400/637.1; 400/637.6

[58] Field of Search ..... 400/636, 636.1, 692, 400/208, 208.1, 636.2, 636.3, 637, 637.1, 637.5, 637.6, 639, 639.2

[56] References Cited

U.S. PATENT DOCUMENTS

| | | | |
|---|---|---|---|
| 4,072,225 | 2/1978 | Manning | 400/636 |
| 4,386,265 | 5/1983 | Sugimori | 400/636 |
| 4,479,598 | 10/1984 | Mailer et al. | 400/636 |
| 4,516,866 | 5/1985 | Yamauchi et al. | 400/636 |
| 4,567,491 | 1/1986 | Lawrence | 400/636 |
| 4,620,807 | 11/1986 | Polit | 400/56 |
| 4,624,588 | 11/1986 | Bivin | 400/636 |
| 4,696,592 | 9/1987 | Oka et al. | 400/636 |
| 4,772,896 | 9/1988 | Nakatsu | 400/636 |

FOREIGN PATENT DOCUMENTS

| | | | |
|---|---|---|---|
| 0071712 | 2/1983 | European Pat. Off. . | |
| 28846 | 2/1980 | Japan | 400/636 |
| 8679 | 1/1983 | Japan | 400/636 |
| 118276 | 6/1986 | Japan | 400/636 |
| 143162 | 6/1986 | Japan | 400/636 |
| 149467 | 7/1987 | Japan | 400/636 |
| 284770 | 12/1987 | Japan | 400/636 |
| 2202209 | 9/1988 | United Kingdom . | |

*Primary Examiner*—Edgar S. Burr
*Assistant Examiner*—Joseph R. Keating
*Attorney, Agent, or Firm*—Guy W. Shoup; David W. Heid

[57] ABSTRACT

A paper feed roller arrangement for a printer which permits exchanging of a ribbon cassette and assures a maximum range of paper on which printing can be made. The paper feed roller arrangement includes two pairs of paper feed rollers, one disposed on the upstream side and one disposed the downstream side of a print head in a feeding direction of paper for feeding the paper in a planar condition. One of the paper feed rollers which is opposed to a path of the ribbon cassette when the ribbon cassette is to be exchanged is disposed for movement toward and away from the print head. Upon ordinary feeding of paper, the movable paper feed roller is positioned proximate the print head where it cooperates with a corresponding paper feed roller to feed the paper. When a ribbon cassette is to be exchanged, the movable paper feed roller is moved away from the print head to increase the spacing in the vicinity of the print head to facilitate such exchanging of the ribbon cassette.

5 Claims, 2 Drawing Sheets

PAPER FEED ROLLER ARRANGEMENT FOR PRINTER

BACKGROUND OF THE INVENTION

1. Field of the Invention

This invention relates to a printer wherein ink on an ink ribbon accommodated in a ribbon cassette is transferred to paper by an action of a print head such as a wire dot head or a thermal head, and more particularly to a paper feed roller arrangement for feeding paper in such printer.

2. Description of the Prior Art

One of such printers as described above wherein printing is accomplished with an ink ribbon has a construction as shown in FIG. 3 wherein paper P is fed in a horizontal plane.

General construction of a conventional printer of this type will be described with reference to FIG. 3. A platen 1 in the form of a flat plate extends parallel to a feeding direction of paper P and is disposed such that a pressure receiving face 2 thereof is directed upward as seen in FIG. 3. A carriage not shown, is mounted for movement in a direction parallel to the platen 1, and a wire dot head 3 is carried on the carriage and disposed above the platen 1 in an opposing relationship to the platen 1. A ribbon cassette 4, shown in phantom in FIG. 3, is also carried on the carriage, and an ink ribbon 5 is accomodated in the ribbon cassette 4 and has an intermediate portion thereof disposed between the platen 1 and the wire dot head 3.

The paper P is fed in the leftward direction as indicated by an arrow mark in FIG. 3 in the horizontal plane between the platen 1 and the wire dot head 3. A pair of paper feed rollers 6A and 6B and another pair of paper feed rollers 7A and 7B for feeding the paper P in the direction indicated by the arrow mark are disposed on the upstream side and the downstream side, respectively, of the wire dot head 3 in the feeding direction of the paper P such that they are in contact with the paper P from above and below. The lower paper feed rollers 6B and 7B have a greater diameter and serve as driving rollers while the upper paper feed rollers 6A and 7A have a smaller diameter and serve as driven or follower rollers.

A conventional printer has a construction as described above. Thus, in order to accomplish printing, the paper feed rollers 6B and 7B are driven to feed the paper P between the paper feed rollers 6A and 6B and between paper feed rollers 7A and 7B a predetermined distance in the directions indicated by the double-sided arrow mark and then stopped at a predetermined location of the paper P which is opposed to the wire dot head 3. In this condition, the carriage, not shown, is actuated to transfer ink on the ink ribbon 5 to the paper P by means of the wire dot head 3 to effect serial printing. Next, the paper feed rollers 6B and 7B are driven to feed the paper P by a distance equal to a one line space and then stopped, whereafter the carriage is actuated to begin serial printing again.

When the ribbon cassette 4 is to be replaced it must be moved substantially in a horizontal direction. Since the direction of such movement coincides with a direction indicated by the double-sided arrow mark in FIG. 3, and since the ribbon cassette 4 is disposed at a location comparatively near the wire dot head 3, a portion of the ink ribbon 5 exposed to the lower end of the ribbon cassette 4 is likely to be contacted with the paper feed roller 7A or 6A. These rollers oppose the passage of the ribbon cassette 4 when a replacement operation of the ribbon cassette 4 is performed. Accordingly, the ribbon cassette 4 must be moved with extreme care so that the ribbon 5 will not contact the paper feed roller 7A, or 6A which makes exchanging of the ribbon cassette 4 cumbersome. Further, if the ink ribbon 5 is contacted with the paper feed roller 7A or 6A, the ink of the ink ribbon 5 is likely to adhere to the paper feed roller 7A. Consequently, the ink may be transferred from the paper feed roller 7A or 6A to the paper P being fed and the paper P may be soiled by the ink.

An improved printer as shown in FIG. 4 which eliminates the drawbacks of the conventional printer described above with reference to FIG. 3 is also known conventionally. In the improved printer shown in FIG. 4, a paper feed roller 7A and a cooperating paper feed roller 7B for are spaced by a greater distance from a wire head 3 than that in the printer shown in FIG. 3.

In the printer shown in FIG. 4, however, the distance between a pair of paper feed rollers 6A and 6B and the paper feed rollers 7A and 7B is correspondingly greater than that in the printer shown in FIG. 3. Accordingly, in the printer of the type wherein printing cannot be performed unless the paper P is held in a taut condition by the paper feed rollers 6A and 6B and the other paper feed rollers 7A and 7B, a significantly large spacing or margin remains on the leading end side and the trailing end side of the paper P. Thus the waste of the paper P is significant.

SUMMARY OF THE INVENTION

It is an object of the present invention to provide a paper feed roller arrangement for a printer which permits ready exchanging of ribbon cassettes and assures a maximum range of paper on which printing can be made.

In order to attain the object, according to the present invention, there is provided a paper feed roller arrangement for a printer wherein a print head for printing with an ink ribbon of a ribbon cassette is disposed in an opposing relationship to a platen, said paper feed roller arrangement comprising two pairs of paper feed rollers one disposed on the upstream side and one disposed the downstream side of the print head in the feeding direction of paper in order to feed the paper in a planar condition, characterized in that one of the paper feed rollers which is opposed to a path of the ribbon cassette when the ribbon cassette is to be exchanged is disposed for movement toward and away from the print head.

With this paper feed roller arrangement for a printer, upon ordinary feeding of paper, the paper feed roller which is opposed to the path of a ribbon cassette is moved to the position near the print head in which it cooperates with the corresponding paper feed roller to feed the paper held between the two paper feed rollers. Accordingly, printing can be made on a wide range of the paper. When a ribbon cassette is to be replaced, the paper feed roller opposed to the path of the ribbon cassette is moved away from the print head to increase the spacing in the vicinity of the print head. Consequently, a ribbon cassette can be exchanged readily without contacting any of the paper feed rollers.

The above and other objects, features and advantages of the present invention will become apparent from the following description and the appended claims, taken in conjunction with the accompanying drawings in which like parts or elements are denoted by like reference numerals.

DETAILED DESCRIPTION OF THE PREFERRED EMBODIMENT

Figure 1:
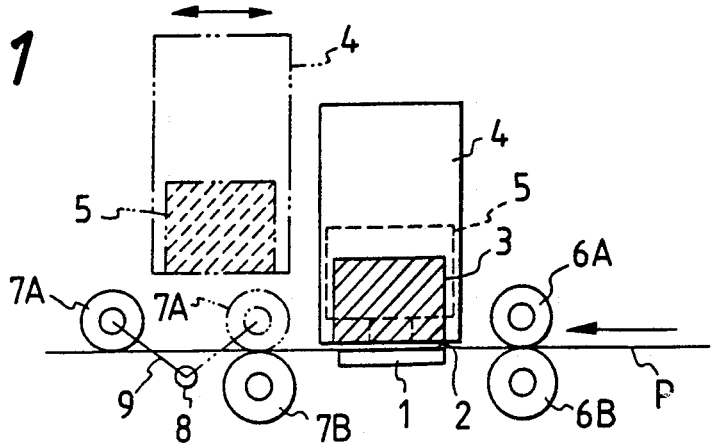
FIG. 1 is a schematic side elevational view showing a printer with a paper feed roller arrangement according to the present invention.

Referring to FIG. 1, there is shown essential part of a printer in which a paper feed roller arrangement according to the present invention is incorporated. A paper feed roller 7A which is opposed to a passage of a ribbon cassette 4 when the ribbon cassette 4 is to be exchanged is supported for rotation at an end portion of a link 9 which is mounted for pivotal motion around a support pin 8. The paper feed roller 7A normally assumes such a position as shown in phantom in FIG. 2 wherein it contacts with another paper feed roller 7B in the vicinity of a wire dot head 3 for example of a print head so that it may cooperate with the paper feed roller 7B to feed paper P held therebetween. When the ribbon cassette 4 is to be exchanged, the link 9 is pivoted in the counterclockwise direction from a position shown in phantom in FIG. 1 to another position shown in solid lines in FIG. 1 to move the paper feed roller 7A away from the wire dot head 3 and provide a greater spacing in the vicinity of the wire dot head 3 to facilitate exchanging of the ribbon cassette 4. It should be noted that the link 9 is pivoted to move the paper feed roller 7A in a substantially horizontal direction between the position proximate the wire dot head 3 and the other position remote from the wire dot head 3. If the paper feed roller 7A were otherwise retracted upwardly, then it's position crosses a passage of the ink ribbon 5 upon replacement of the ribbon cassette 4 and accordingly a significantly greater distance would be required to allow such movement. If it were attempted to retract the paper feed roller 7A otherwise downwardly, the presence of the paper P would inhibit such movement. Furthermore, in order to move the paper feed roller 7A in its axial direction, downward the paper feed roller 7B would need to be moved which would require a very complicated construction.

Figure 2:
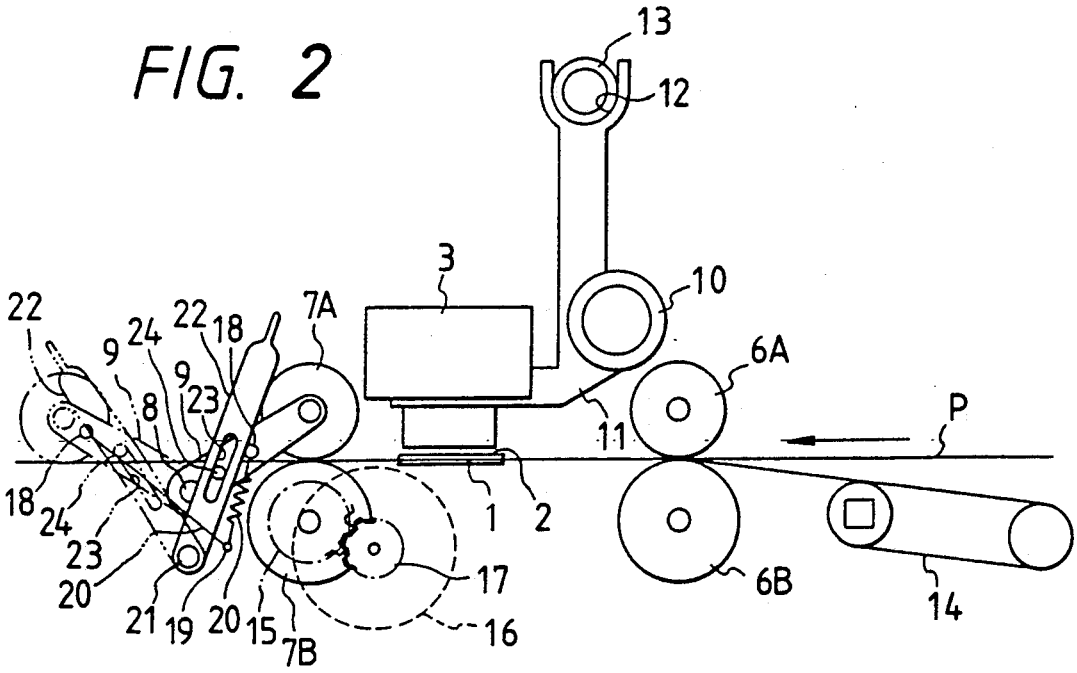
FIG. 2 is a schematic side elevational view of a preferred embodiment of the paper feed roller arrangement of FIG. 1.
Figure 3:
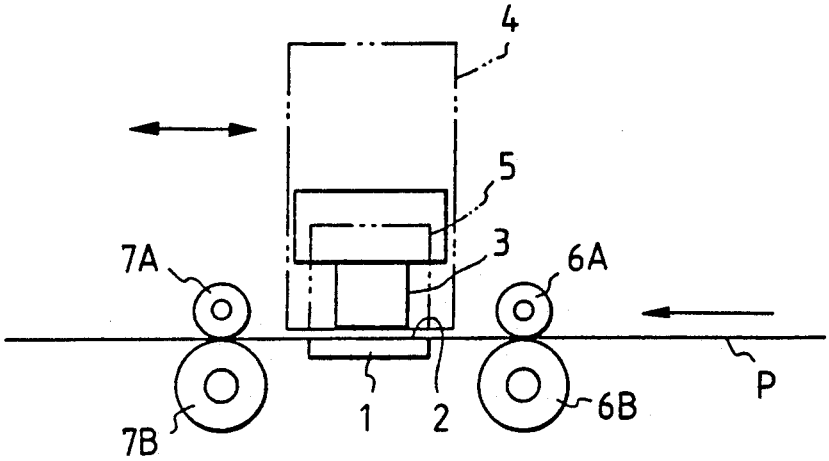
FIG. 3 PRIOR ART
FIGS. 3 and 4 are schematic side elevational views showing printers in which different conventional paper feed roller arrangements are incorporated.
Figure 4:
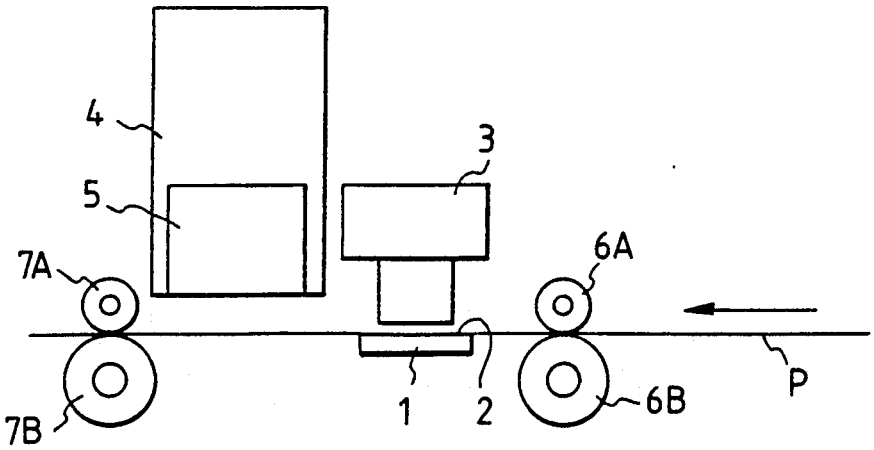
FIG. 4 PRIOR ART

Referring now to FIG. 2, there is shown the printer in more detail. A support shaft 10 is disposed proximate a paper feed roller 6A and extends in parallel to an axis of a platen 1. A carriage 11 is supported for movement on the support shaft 10 and has the wire dot head 3 carried thereon. The carriage 11 has such a substantially L-shaped general configuration as seen in FIG. 2 and has U-shaped groove 12 formed at an upper end portion thereof. A guide rod 13 is disposed in parallel to the support shaft 10 and fitted in the U-shaped groove 12 of the carriage 11 so that it may guide the carriage 11 when the carriage 11 is actuated. It is to be noted that the carriage 11 is connected to a belt not shown so that it may be moved along the support shaft 10 by the belt when the belt is driven to circulate.

The printer shown in FIGS. 1 and 2 is constructed to permit use of the paper P not only in the form of cut paper but also in the form of continuous or fan-fold paper. Thus a tractor 14 for supplying fan-fold paper is disposed on the upstream side of the paper feed rollers 6A and 6B in the feeding direction of the paper P.

The support pin 8 for the link 9 on which the paper feed roller 7A is supported is located on the downstream side in the feeding direction of the paper P and the link 9 is proximate the paper feed roller 7B when in contact with the paper feed roller 7A, and at the position proximate the wire dot head 3 shown in FIG. 2. The paper feed roller 7A is contacted by with the paper feed roller 7B which is located below the paper P when it is fed. It should be noted that the paper feed roller 7B is driven by a gear wheel 17 which is disposed in a coaxial relationship with a driving side reduction gear wheel 16 and held in meshing engagement with another gear wheel 15 disposed in a coaxial relationship with the paper feed roller 7B.

A pin 18 is provided projectingly at an intermediate location in the longitudinal direction of the link 9, and a coil spring 20 for pulling the pin 18 is stretched between the pin 18 and another pin 19 at a fixed location. The coil spring 20 here serves as a center-over spring depending upon a pivotal position of the link 9 such that it urges the link 9 in the clockwise direction when it is positioned on the right-hand side of the support pin 8, which provides the center of pivotal motion of the link 9, and such that it urges the link 9 in the counterclockwise direction when it is positioned on the left-hand side of the support pin 8.

An operation lever 22 is disposed proximate the link 9 and supported for pivotal motion around a support pin 21. The operation lever 22 has an elongated hole 23 formed therein and extending in a longitudinal direction thereof. The link 9 has a pin 24 provided projectingly thereon, and the pin 24 is fitted for sliding movement in the elongated hole 23 in the operation lever 22. Accordingly, as the operation lever 22 is pivoted, the link 9 is pivoted while the pin 24 thereon is moved in the elongated hole 23 in the operation lever 22. It should be noted that the position of the pin 24 and the position and the length of the elongated hole 23 are set such that, when the pin 24 assumes a position as shown in phantom in FIG. 2 wherein it almost contacts with the paper P, the pin 24 on the link 9 is positioned, at an end of the elongated hole 23 of the operation lever 22 in order to prevent the link 9 from being pivoted further in the counterclockwise direction.

When normal printing is to be performed, the paper feed roller 7A is positioned in the vicinity of the wire dot head 3 as indicated by solid lines in FIG. 2. In this condition, the paper feed roller 7A is urged in the direction in which it is resiliently contacted with the paper feed roller 7B by an action of the coil spring 20. Accordingly, the paper feed roller 7A and the cooperating paper feed roller 7B can make an ordinary paper feeding operation as the paper feed roller 7B is driven to rotate.

When the ribbon cassette 4 is to be exchanged, the operation lever 22 is pivoted in the counterclockwise direction from the solid line position in FIG. 2. Since, since the pin 24 on the link 9 is fitted in the elongated hole 23 of the operation lever 22, the link 9 is pivoted in the counterclockwise direction against the urging force of the coil spring 20 to move the paper feed roller 7A away from the paper feed roller 7B. After the pivotal motion of the operation lever 22 in the counterclockwise direction is continued until the coil spring 20 crosses a change point between the left-hand side and the right-hand side of the support pin 8, the coil spring 20 acts to urge the link 9 in the counterclockwise direction. Consequently, the link 9 and the operation lever 22 are thereafter pivoted automatically by the urging force of the coil spring 9 until the pin 24 of the link 9 reaches the end of the elongated hole 23 of the operation lever 22. Accordingly, the paper feed roller 7A is moved to such a position as indicated in phantom in FIG. 2 together with the link 9 and the operation lever 22, and spaced by a maximum distance from the wire dot head 3.

Since, a great spacing is formed in the vicinity of the wire dot head 3, replacement of the ribbon cassette 4 can be performed readily. There is little possibility that ink on the ink ribbon 5 in the ribbon cassette 4 may adhere to the paper feed roller 7A and soil the paper P.

It should be noted that, after completion of the exchanging operation of the ribbon cassette 4, the operation lever 22 should be pivoted in the clockwise direction to return the paper feed roller 7A to the solid line position shown in FIG. 2.

In this manner, according to the present embodiment, when the ribbon cassette 4 is to be replaced the paper feed roller 7A opposed to the passage of the ribbon cassette 4 can be moved to the position spaced away from the wire dot head 3 only by manually pivoting the operation lever 22. Accordingly, the position of the paper feed roller 7A can be changed between the position for printing and the other position for exchanging the ribbon cassette 4, to facilitate exchanging of the ribbon cassette 4. When printing, the paper feed roller 7A is positioned proximate the wire dot lead 3, the paper fed roller 7B and the other pair of paper feed rollers 6A and 6B. Accordingly, the paper P can be held in a taut condition within a small range between the pairs of paper feed rollers 6A, 6B and 7A, 7B, and printing can be made over a wide range of the paper P.

It is to be noted that the present invention is not limited to the specific embodiment described hereinabove and various alterations and modifications can be made thereto without departing from the spirit and scope of the invention as set forth herein. For example, movement of the paper feed roller opposed to the passage of a ribbon cassette upon exchanging may be provided by linear motion rather than by pivotal motion.

What is claimed is:

1. A paper feed roller arrangement for a printer wherein a print head for printing with an ink ribbon of a ribbon cassette is disposed in an opposing relationship to a platen, said paper feed roller arrangement comprising:

two pairs of paper feed rollers, one of said pairs being disposed adjacent to and on the upstream side of said print head and the other of said pairs of rollers being disposed adjacent to and on the downstream side of said print head when considered with respect to a paper feeding direction, one roller of said downstream pair of feed rollers located in a ribbon cassette installation path; and means for moving said one roller of said downstream pair of feed rollers toward and away from said print head, wherein a range of motion of said one roller includes a portion outside said path of the ribbon cassette when the ribbon cassette is to be exchanged.

2. A paper feed roller arrangement according to claim 1, wherein said means for moving said one roller, comprises a link coupled to said one roller for supporting and moving said one roller about a pivot point to separate said one roller from a second roller which is opposed to and forms a pair with said one roller.

3. A paper feed roller arrangement for a printer wherein a print head for printing with an ink ribbon of an ink ribbon cassette is disposed in an opposing relationship to a platen and wherein said ink ribbon cassette moves through an installation path during a replacement operation of said ink ribbon cassette, said paper feed roller arrangement comprising a pair of paper rollers disposed adjacent to said print head for holding a paper during printing, wherein a first roller of said pair of rollers is disposed in said installation path during a printing operation and a second roller of said pair of rollers is fixedly located opposite said first roller and means to move said first roller away from said print head and said second roller, out of said installation path during a replacement operation of said ink ribbon cassette, wherein said first roller and said second roller are operatively coupled.

4. A paper feed roller arrangement as in claim 1, wherein said means for moving said first roller comprises a link operatively coupled with said first roller, said link being movable about a first support pin.

5. A paper feed roller arrangement as in claim 4, wherein said means for moving said first roller further comprises an operating lever having an elongated hole which is slidably engaged with a control pin operatively coupled with said link, wherein movement of said operating lever about a second support pin in a first and a second direction causes said first roller to be moved toward and away from said print head, respectively.

* * * * *